United States Patent [19]

Carr

[11] 4,109,487

[45] Aug. 29, 1978

[54] MOISTURE EXTRACTOR

[75] Inventor: Herbert Carr, Newfane, N.Y.

[73] Assignee: General Motors Corporation, Detroit, Mich.

[21] Appl. No.: 760,338

[22] Filed: Jan. 18, 1977

[51] Int. Cl.[2] ..... F25B 43/00

[52] U.S. Cl. ..... 62/474; 62/85

[58] Field of Search ..... 62/474, 85, 315, 316, 62/475; 138/123, DIG. 4; 261/2, 3; 210/500 M, 507

[56] References Cited

U.S. PATENT DOCUMENTS

| | | | |
|---|---|---|---|
| 2,260,608 | 10/1941 | Cormack | 62/474 |
| 2,546,594 | 3/1951 | Gray | 62/474 |
| 2,548,965 | 4/1951 | Gaugler | 62/474 |
| 2,579,053 | 12/1951 | Schulstadt | 62/474 |
| 2,758,719 | 8/1956 | Line | 62/474 |
| 3,119,244 | 1/1964 | Fabian | 62/474 |
| 3,545,227 | 12/1970 | Grahl | 62/474 |
| 3,572,050 | 3/1971 | Bottam | 62/474 |
| 3,817,386 | 6/1974 | Frost et al. | 210/500 |

*Primary Examiner*—Lloyd L. King
*Attorney, Agent, or Firm*—K. H. MacLean, Jr.

[57] ABSTRACT

In a refrigerant system utilizing flexible hoses extending between the compressor and the other heat exchanger components, dehydration apparatus to remove moisture from the refrigerant which has passed from the atmosphere into the refrigerant system through the flexible hoses. The dehydrator includes water-impermeable housing means for a desiccant material, such as silica gel, which encircles portions of flexible hose to create a low humidity environment thereabout. Moisture in the system migrates through the flexible hose portion to the dry atmosphere produced by the desiccant material in response to the differential humidity.

6 Claims, 5 Drawing Figures

MOISTURE EXTRACTOR

This invention relates to refrigerant dehydration apparatus and particularly to a dehydration apparatus external to a refrigerant system to remove moisture from the system and which permits servicing the dehydration apparatus without discharging refrigerant from the system.

Prior refrigerant systems have typically provided a dehydration means to separate water from refrigerant within the air conditioning system and to prevent the separated water from recirculating. Water mixed with refrigerant in a refrigeration system has several undesirable effects. The efficiency of the air conditioning system is decreased when significant quantities of water are mixed with the refrigerant. Also, water in association with chemical reactions with metal components of the system may create corrosion problems. Therefore, all refrigeration systems commonly utilize a dehydration means.

The dehydration apparatus typically utilized in prior refrigerant systems includes a quantity of desiccant material in the refrigerant system itself so that moisture will be extracted from the refrigerant as it passes over the desiccant material. A common desiccant utilized in refrigerant systems is silica gel, which has a capacity to absorb a large quantity of water for a given volume. A problem with this internal type of dehydration apparatus is that the refrigerant must be discharged from the system before an exhausted charge of desiccant can be replaced with a fresh charge. Typically, the refrigerant is released to the atmosphere during these service procedures.

The subject externally located dehydration apparatus utilizes a desiccant material such as silica gel, but places the desiccant in an external location so that it is externally accessible. Rubber or rubber-like flexible hoses are by necessity used between the air conditioning compressor and other components. This is true of vehicle air conditioning systems in which the compressor is mounted upon an internal combustion engine and driven thereby. The hoses extend from the engine-mounted compressor to the body-mounted air conditioning components so that relative movement therebetween can be accommodated. Since modern refrigerants such as the fluorocarbon compounds have a complex chain-like molecule, refrigerant does not permeate through the flexible hoses to any appreciable extent. However, the movement of the less complex water molecule through the hose occurs at a much greater rate and appreciable quantities of water can move from the atmosphere into the refrigeration system. This is particularly true when an air conditioning system is operated in areas where the humidity is high. The present invention utilizes a water-impermeable support or housing means for a desiccant material, both encircling a portion of a flexible hose so that an extremely dry atmosphere is created adjacent the hose. The dry atmosphere draws moisture through the hose or membrane from the refrigerant system for absorption by the desiccant material. Because of its external location and accessibility, the desiccant material may be replaced when necessary.

Therefore, an object of the present invention is to provide an externally accessible dehydration means adapted to encircle a refrigerant flow directing member, such as a flexible hose of a refrigerant system, thus creating a dry atmosphere thereabout to draw moisture from the system.

A still further object of the present invention is to provide a dehydration system for refrigerant systems, including a water-impermeable housing with an interior which is selectably accessible, contains a quantity of desiccant material and encloses a refrigerant flow directing member of the refrigerant system.

A still further object of the present invention is to provide a dehydration apparatus for an air conditioning system with water-impermeable means which can be placed about a portion of a flexible and permeable refrigerant flow directing member and enclosing desiccant material adjacent the outer surface of the hose so that a dry atmosphere is produced to draw moisture from the refrigerant passing through the hose.

Still further objects and advantages of the present invention will be more readily apparent from the following detailed description, reference being had to the accompanying drawings in which preferred embodiments are illustrated.

IN THE DRAWINGS

Figure 1:
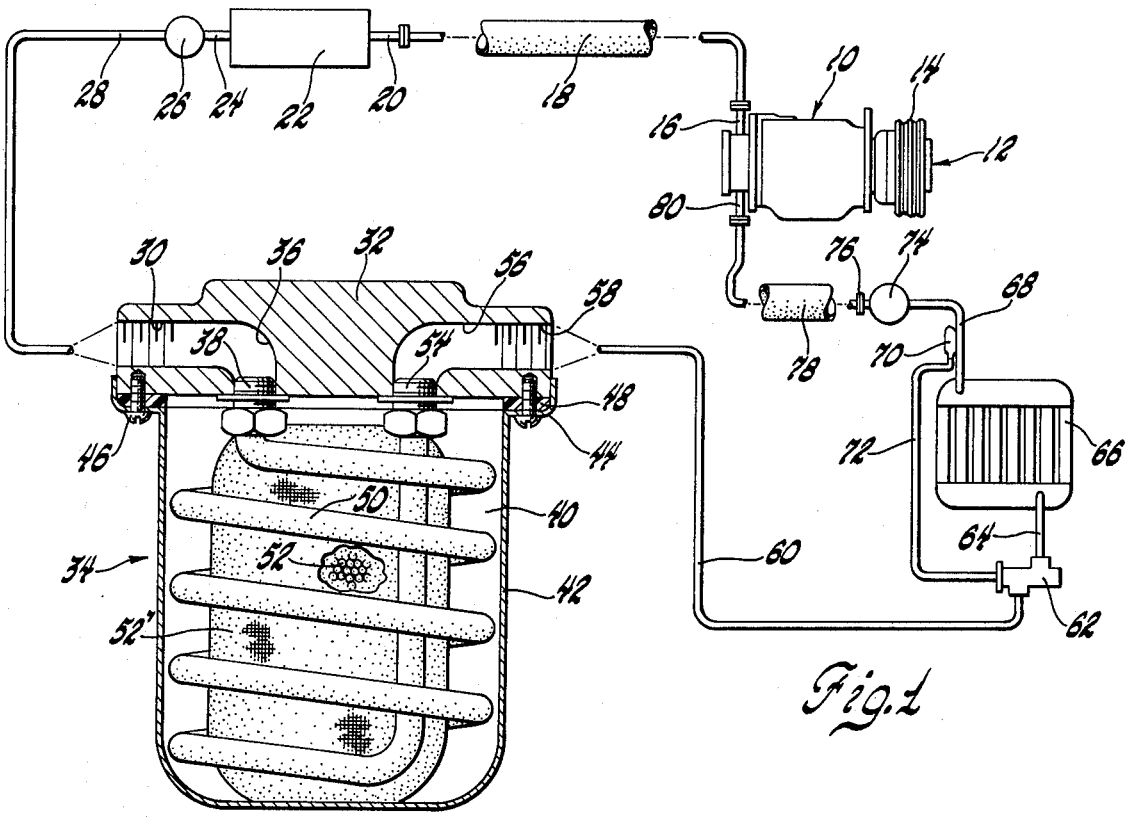
FIG. 1 is a schematic illustration of an air conditioning system, including the subject externally accessible dehydration apparatus.

In FIG. 1 of the drawings, an air conditioning system is illustrated. The system includes a compressor 10 which may be of the axially oriented piston type currently used on some General Motors automobiles. The compressor 10 includes a shaft upon which an electromagnetically controlled clutch assembly 12 is attached. The clutch assembly 12 includes a V-belt pulley 14. The V-belt pulley 14 is adapted to engage by V-belts (not shown) a similar V-belt pulley on the crankshaft of the engine for driving the compressor to cause refrigerant to flow through the system.

From the compressor 10, high pressure, heated refrigerant passes from an outlet fitting 16 through a flexible hose 18 which may be made of rubber or rubber-like material. Refrigerant next flows through an inlet fitting 20 of a condenser 22 where refrigerant is cooled and liquified. Refrigerant passes from the condenser 22 and flows through an outlet or conduit 24 to an adjacent receiver 26 which separates liquid from vaporous refrigerant and passes liquid refrigerant on to flow through conduit 28. Conduit 28 is of metallic composition as there is little movement or vibration between the air conditioning components, with the exception of connections with the compressor 10.

The conduit 28 is attached to a threaded inlet 30 in an end member 32 of a dehydration apparatus 34. Refrigerant flows through an inlet passage 36 in member 32 to a fitting 38 which opens to a sealed interior space 40 defined by the end member 32 and a cup-shaped member 42. Member 42 has an outwardly extending flange portion 44 which is fastened to the end cap by fasteners 46. A gasket member 48 between the flange portion 44 and the end cap member 32 insures that moisture will not leak into the interior 40. Attached to fitting 38 is a flexible hose member 50 which spirally winds through the interior 40 around a quantity of desiccant material 52. Preferably, the desiccant is silica gel which is enclosed in an envelope 52' of plastic screen material. Currently, a similar desiccant bag of silica gel is internally used in General Motors air conditioning systems. The flexible hose 50 may be made of nylon or several other materials. The material which hose 18 is made of may be utilized. In any event, the flexible hose 50 is a water-permeable material as compared to the metallic conduit, such as conduit 28 of the air conditioning system.

The hose 50 extends from inlet fitting 38 to an outlet fitting 54. Refrigerant then passes through an outlet passage 56 to a threaded outlet 58. A metallic conduit 60 is connected between the outlet 58 and the inlet of a thermostatic expansion valve 62. The outlet of valve 62 is connected by a short metallic conduit 64 to the bottom portion of an evaporator 66. From there, the refrigerant is discharged from the evaporator 66 through a metal conduit 68.

The flow of refrigerant into the evaporator 66 is controlled by the expansion valve 62 in response to a temperature condition at the evaporator outlet as sensed by a bulb 70 and a capillary line 72. As the operation of thermal expansion valves is well known in the refrigerant field, further details will be omitted. For more detail, reference may be had to any number of prior publications and patents relating to expansion valves.

Refrigerant next flows through conduit 68 into a suction throttling valve 74. Like the expansion valve 62, the suction throttling valve 74 is a known refrigerant component and any number of reference materials are available to provide ample detail. Therefore, details will be omitted from this description, as the particular structure and function of the valves 62, 74 are not particularly relevant to this invention.

From the suction throttling valve 74, refrigerant flows into a fitting 76 and hence through a flexible hose 78 to the inlet 80 of the compressor 10. The hose 78 is preferably made of the same material as the hose 18 previously discussed.

When the air conditioning system is operated over an extended period of time, particularly in a high humidity and temperature enviornment, appreciable quantities of water from the atmosphere may pass through the flexible hoses 18, 78 into the refrigerant system. As previously explained, this is detrimental to the operation and to the durability of an air conditioning system. The subject externally located dehydrating apparatus 34, and in particular the hose 50 therein, operates to remove water in the refrigerant system. The interior 40 of apparatus 34 is maintained at an extremely low humidity due to the water-absorbing properties of the silica gel 52 therein. Over a period of time, the silica gel will absorb moisture from the air conditioning system and may eventually reach a practical limit to its water-absorbing capacity. At that time, it is desirable to remove fasteners 46 and separate the members 32, 42 so that a fresh quantity of desiccant material 52 may replace the old desiccant in the interior 40. Thereafter, the apparatus 34 will continue to remove moisture from the refrigerant system. It should be noted that refrigerant is not discharged from the system during the aforementioned replacement operation.

Figure 2:
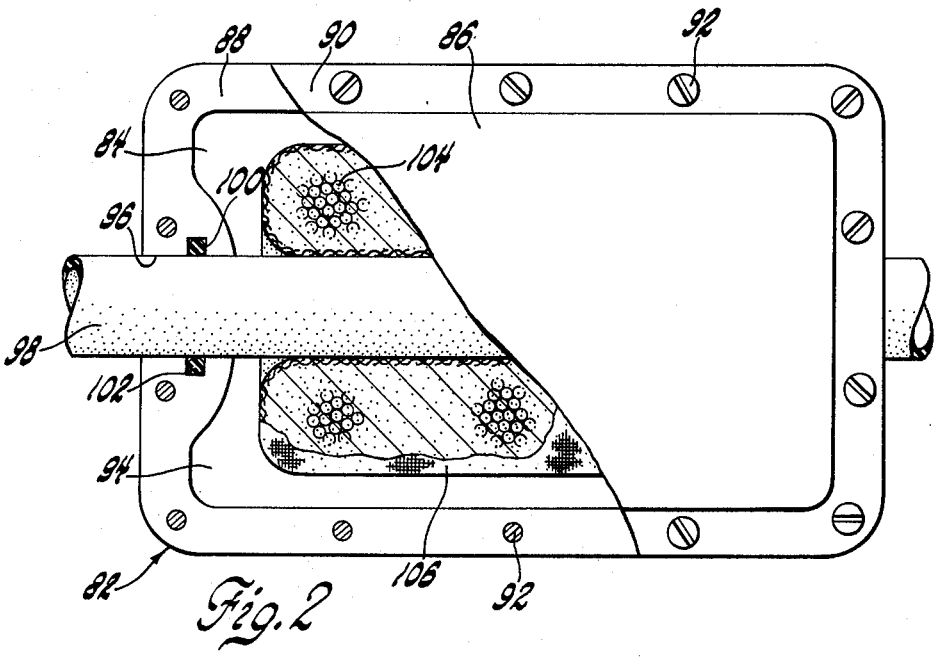
FIG. 2 is a view of a second embodiment of the subject invention mounted upon a portion of flexible hose of the air conditioning system shown in FIG. 1.

A second embodiment of a dehydrating apparatus is illustrated in FIG. 2. This apparatus 82 includes a housing including a first part 84 and a second part 86, both of which have radially extending flange portions 88 and 90 thereon. Fasteners 92 extend through the flange portions 88, 90 to attach the portions together and to define an interior space 94 therebetween. Circular apertures or openings 96 are formed at either end of the housing portions 84, 86 (illustrated at left end only) so that a portion of flexible hose 98 may extend through the interior 94. O-ring seals 100 encircle the hose and are held within recesses 102 to prevent leakage of moisture-laden air into the interior 94 from the atmosphere. A quantity of desiccant material 104, preferably in the form of silica gel, is contained within an envelope or bag 106, to create an extremely dry atmosphere in the interior 94. The dry atmosphere of interior 94 will cause moisture to pass through the walls of the flexible hose 98 and to the desiccant material 104. Once the desiccant material 104 has become appreciably "wet", a fresh charge of desiccant can be inserted by removing the fasteners 92 and separating the members 84, 86 to expose the interior 94.

Figure 3:
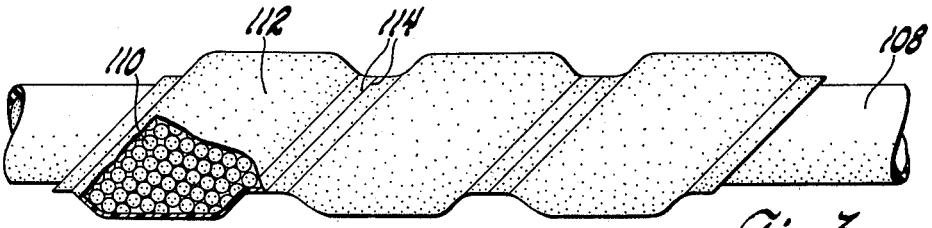
FIG. 3 is a third embodiment of the subject invention.

In FIG. 3, a third embodiment of a dehydrating apparatus is shown which has particular applicability to the service of older air conditioning systems which may have accumulated a quantity of water therein. A quantity of desiccant material in the form of small silica beads 110 is held adjacent the outer surface of a flexible hose 108 by a wrapping of water-impervious and flexible plastic material 112. The material 112 is preferably wound about the outer surface of hose 108 in a spiral form with the edges 114 thereof abutting one another so as to provide as good a seal as possible. This produces a relatively low humidity atmosphere about the outer surface of the hose 108 and causes water from the refrigerant system to pass through the hose and into the desiccant material 110.

Figure 4:
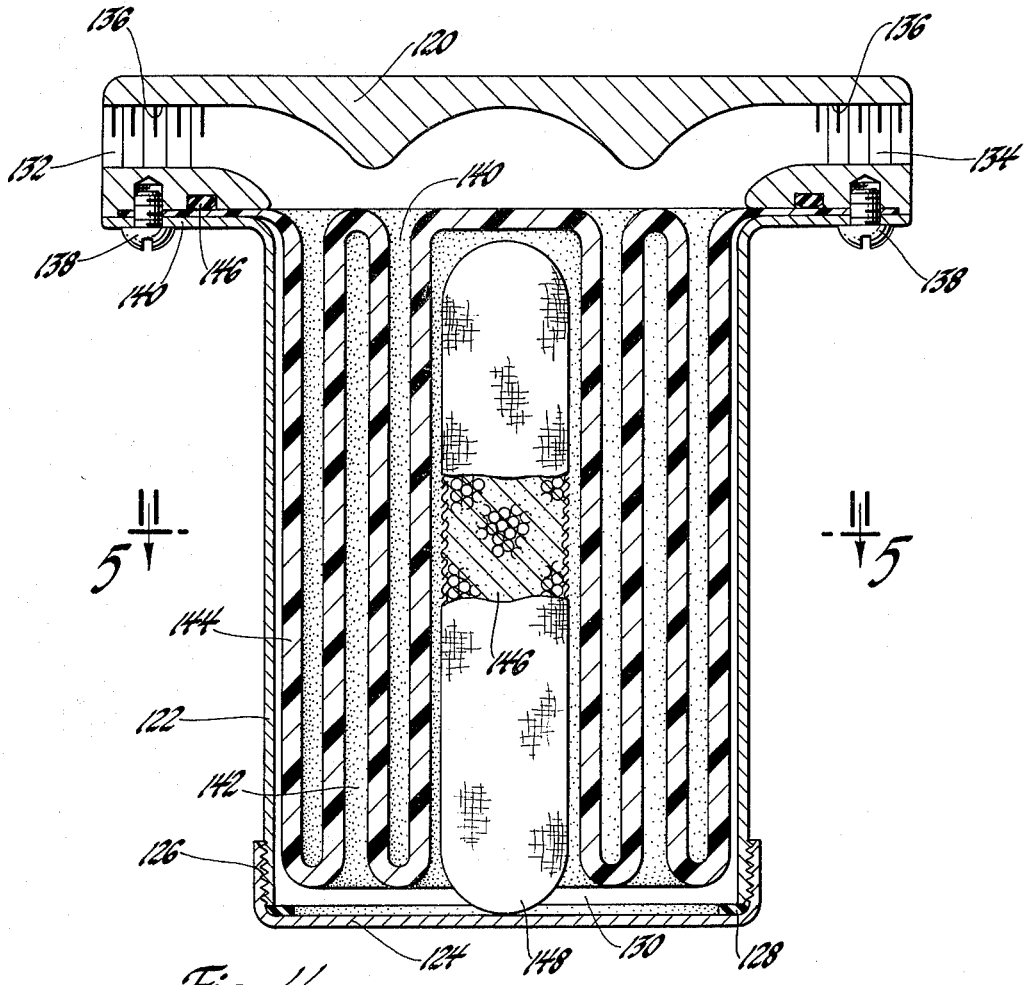
FIG. 4 is a sectioned view of a fourth embodiment.
Figure 5:
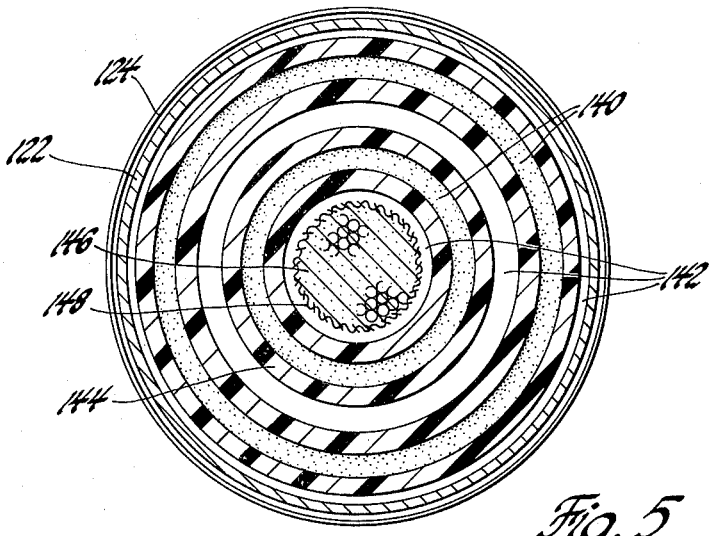
FIG. 5 is a sectioned view of the fourth embodiment taken along section lines 5—5 in FIG. 4.

In FIGS. 4 and 5, a fourth embodiment is illustrated including an enclosure formed by an end member 120, a cylindrical side wall member 122 and an end closure 124. Closure 124 is threadably fastened at 126 to side wall member 122. A gasket 128 between members 124 and 122 prevents the entry of air and moisture to the interior space 130 formed by the enclosure.

The end member 120 has an inlet opening 132 and an outlet opening 134 with threaded portions 136 therein for attachment to a refrigerant inlet and outlet, respectively. Threaded fasteners 138 extend through an outward flange portion 140 of member 122 and into end member 120. The interior 130 is separated into spaces 140, 142 for refrigerant and air, respectively, by a molded cylindrical membrane 144. The membrane 144 is supported at one end between members 120 and flange portion 140. An O-ring 146 within a groove in member 120 helps prevent leakage of refrigerant from space 140. Membrane 144 is molded into substantially concentric portions so as to attain a length compatible with the enclosure housing.

The membrane 144 is of a material such as nylon which is permeable to water, yet is relatively impermeable to the passage of refrigerant. A quantity of silica gel desiccant 146 is held within a bag enclosure 148 in the manner of embodiment One. The desiccant 146 produces a very dry atmosphere in space 142 which induces moisture in the refrigerant system and space 140 to pass through the membrane 144 to the desiccant. An advantage of this embodiment over the other embodiments is the large surface area of the membrane exposed to refrigerant and the dry atmosphere. Whereas it has been demonstrated that the moisture extractor corresponding to the other embodiments will operate to remove moisture, the fourth embodiment is believed to represent a more efficient approach. Certainly, for extraction of a given body of moisture, the fourth embodiment will operate at a faster extraction rate.

When the desiccant 146 becomes saturated with moisture, the end cap 124 can be removed and a fresh supply of desiccant inserted in space 142 without discharging the refrigerant.

The embodiments described in detail heretofore and illustrated in the drawings constitute preferred embodiments, although other embodiments may be adapted and still fall within the scope of the following claims which define the invention.

What is claimed is as follows

1. In a refrigerant system having a closed fluid circuit, including flexible hose means with hose walls somewhat permeable to the movement of water therethrough in response to differential humidity between the atmosphere and the refrigerant circuit, an externally accessible dehumidifying apparatus comprising:

enclosure-forming means of water-impermeable material defining an interior space, including a detachable closure member providing access to said interior space;

inlet and outlet forming means to and from said interior space adapted to be fluidly connected in said fluid circuit for flow through said interior space; means including a member of material permeable to the passage of water therethrough separating the interior space of said enclosure into a fluid-carrying portion and a dry atmosphere portion, with said detachable closure member exposed to said atmosphere portion and said inlet and outlet forming means exposed to said fluid-carrying portion;

a quantity of desiccant material within said dry atmosphere portion for holding moisture which passes through said permeable member from said fluid-carrying portion in response to the differential humidity therebetween.

2. The apparatus of claim 1 in which said permeable separating member is a membrane attached to said enclosure-forming means at a peripheral outer edge with the midportion thereof folded in substantially concentric portions to encircle said desiccant material and providing a large surface exposed on one side to refrigerant and on the opposite side to the dry atmosphere.

3. In a refrigerant system having a closed fluid circuit including flexible hose conduit with a wall permeable to the movement of water therethrough in response to differential humidity between the atmosphere and the refrigerant circuit, an externally accessible dehumidifying apparatus comprising:

a housing member of water-impervious material defining an interior space and having an inlet opening and an outlet opening adapted to engage portions of said flexible hose so that a midportion of the hose extends through said interior space;

a quantity of desiccant material within said space, thereby producing a low humidity atmosphere in said interior space about the midportion of said flexible hose whereby water flowing in the flexible hose is induced by differential humidity to pass through the wall of said hose midportion to said desiccant material.

4. In a refrigerant system having a closed fluid circuit including flexible hose conduit with a wall permeable to the movement of water therethrough in response to a humidity differential between the atmosphere and the refrigerant circuit, an externally accessible dehumidifying apparatus comprising:

housing means of water-impervious material including a first and a second member defining an interior space;

inlet and outlet means for refrigerant in said first housing member;

a length of water-permeable hose within said interior space and connected in series flow relation to said inlet and said outlet for passing refrigerant through the hose;

a quantity of desiccant material within said interior space, thereby producing a low humidity atmosphere about said water-permeable hose to induce water to pass through the walls of said hose to the desiccant material.

5. The externally accessible dehumidifying apparatus of claim 4 in which the housing member parts are held together by disengageable fasteners to permit access to the interior space and replacement of an old charge of desiccant material with a new charge without releasing the refrigerant.

6. In a refrigerant system having a closed fluid circuit including a flexible hose conduit with a wall permeable to the movement of water therethrough in response to a differential humidity between the atmosphere and the refrigerant circuit, an external dehumidifying apparatus comprising:

a flexible and water-permeable material in tape configuration adapted to be wrapped about a portion of said flexible hose with adjacent edges in abutting sealing engagement with one another;

desiccant material held between said tape and the outer surface of said hose conduit, thereby producing a low humidity atmosphere about said hose to induce water to move from the refrigerant circuit through the walls of said hose to said desiccant material.

* * * * *

UNITED STATES PATENT AND TRADEMARK OFFICE

CERTIFICATE OF CORRECTION

PATENT NO. : 4,109,487

DATED : August 29, 1978

INVENTOR(S) : Herbert Carr

It is certified that error appears in the above-identified patent and that said Letters Patent are hereby corrected as shown below:

Column 6, line 45, "water-permeable" should read -- water-impermeable --.

Signed and Sealed this

*Seventh* Day of *August 1979*

[SEAL]

*Attest:*

*Attesting Officer*

LUTRELLE F. PARKER

*Acting Commissioner of Patents and Trademarks*